United States Patent [19]

Zulkoski et al.

[11] Patent Number: 5,038,686

[45] Date of Patent: Aug. 13, 1991

[54] SPHERICAL WARHEAD

[75] Inventors: Thomas R. Zulkoski; Robert G. S. Sewell, both of Ridgecrest, Calif.

[73] Assignee: The United States of America as represented by the Secretary of the Navy, Washington, D.C.

[21] Appl. No.: 796,147

[22] Filed: Nov. 8, 1985

[51] Int. Cl.[5] ..... F42B 12/32

[52] U.S. Cl. ..... 102/496; 102/481

[58] Field of Search ..... 102/481, 491–497

[56] References Cited

U.S. PATENT DOCUMENTS

| | | | |
|---|---|---|---|
| 3,136,251 | 6/1964 | Witow | 102/67 |
| 3,224,371 | 12/1965 | Kempton et al. | 102/67 |
| 3,298,308 | 1/1967 | Throner, Jr. | 102/496 |
| 3,508,493 | 4/1970 | Clenick | 102/67 |
| 3,724,379 | 4/1973 | Davis | 102/49.3 |
| 4,016,816 | 4/1977 | Larsson et al. | 102/494 |
| 4,037,539 | 7/1977 | Hackman | 102/67 |
| 4,147,108 | 4/1979 | Gore et al. | 102/67 |
| 4,411,199 | 10/1983 | Yates | 102/481 |

*Primary Examiner*—Harold J. Tudor
*Attorney, Agent, or Firm*—Sol Sheinbein; Harvey A. Gilbert; Melvin J. Sliwka

[57] ABSTRACT

A spherical warhead is disclosed which yields a greater than 120° shaped charge of preformed fragments and which further permits non-destructive cook-off of explosives to prevent undesirable detonation.

1 Claim, 1 Drawing Sheet

SPHERICAL WARHEAD

BACKGROUND OF THE INVENTION

1. Field of the Invention

The invention lies in the realm of mechanics and ballistics. More particularly, the invention discloses a shaped charge explosive yielding a 120° shaped charge, particle dispersion, radially from the point of detonation, and further discloses an improved warhead cook-off capability to prevent an undesirable explosion/detonation of the warhead.

2. Description of the Prior Art

Anti-Radiation Missile (ARM) warhead designs are premised on the assumption that the missile they are employed in will not impact on a vulnerable region of the target. This is essentially the case as the aimpoint is on the transmitter antenna; however, an impact on the antenna usually will only degrade the performance of the radar. As a result such warheads are designed to produce significant levels of damage without actually impacting on the target. This is accomplished through the explosive dispersion of a large number of metallic fragments. In the design of ARM warheads, two basic factors must be taken into account. These factors are the probability of hitting the target, PH, and the probability of killing the target, PKH, given a hit by the fragmentation. The overall probability of killing the target, PK, is the product of these two factors.

$$PK = PH \times PKH$$

Since no probability value can ever exceed 1, the system PK can never exceed either PH or PKH. Theses two factors, PH and PKH, are interrelated through the warhead design. The probability of a hit (PH) is a function of the miss distance which is controlled by the guidance system, the burst point location which is controlled by the fuze, and the number of fragments and their impact densities on intercepting the target which is controlled by the warhead design. The probability of kill (PKH), given a hit, is controlled by the placement and shielding of the components, i.e. the target, size of the fragments, and impact densities on intercepting the target. As can be seen, the impact densities are an important element in determining a target kill. This, however, results in conflicting requirements being placed on the warhead design, the need for high impact densities, for high PKH's, but large dispersion angles, for high PH's, which leads to low impact densities. Past warhead designs for ARM applications have usually employed a cylindrical shape with an ogival front end. When looked at in cross section, the warhead design appears as a series of stepped layers of fragmentation along the length with an explosive fill in the center. When the warhead is detonated in a static environment, the fragmentation, except for the ogive, is projected radially outward, the sections with the larger number of fragments being projected at a lower velocity than the sections with fewer fragments. When a missile with a sufficiently high terminal velocity is used with the warhead in that missile, this fragment pattern turns into an expanding cone of fragmentation due to the vector addition of missile and fragment ejection velocity. This design approach has certain limitations. First, it requires relatively high terminal missile velocities to achieve proper fragment dispersion. Second, because it is an expanding cone, it relies upon proper burst point control by the fuze so that the warhead does not detonate after it has passed the target. This requires a sophisticated fuze and/or a relatively small miss distance which requires more sophisticated guidance. More specifically, it requires that target location along the trajectory be known with respect to fuze and guidance systems. As a result very simple fuzing, such as fixed height of burst fuzes, cannot be readily used with this type of warhead.

Therefore, there exists a continuing need for a more effective warhead that can yield a greater probability of kill in near miss situations with less sophisticated fuze and guidance equipment, less missile terminal velocities, and a radially shaped charge having an expanding cone of projectiles to the rear (aft) as well as to the leading edge (fore) of the fly by missile.

SUMMARY OF THE INVENTION

The invention is a spherical shaped warhead which yields a greater than a 120° shaped charge. The warhead consists of two closely spaced concentric spheres truncated with flat bulkhead/cover plates on a fore and aft end of the spheres. A plurality of preformed fragmentation cubes is interspersed and potted between the two concentric spheres above and below a central porous annular ring which circumvents between and couples the concentric spheres together. The interior of the central sphere is filled with a high explosive (main charge) surrounding a cylindrical channel extending between the two cover plates for holding a fuze and a detonator (booster charge). Cookoff holes/vents are provided in a booster charge loading port disc, said disc being threaded into said fore cover plate, to permit release of expanding gases of fuel decomposition to prevent pressure buildup which might cause undesirable detonation.

OBJECTS OF THE INVENTION

It is therefor a primary object of the invention to provide a shaped charge warhead having a large polar dispersion angle, greater than a 120° fragmentation spread, radially from the point of detonation.

Another object is to utilize preformed fragments disposed between an inner and an outer shells of a spherical warhead.

Yet another object is to provide a warhead which permits, but does not require, low missile terminal velocities and further requires less sophisticated fuze and guidance systems while still achieving high kill probabilities.

A further primary, object of the invention is to incorporate in a missile warhead a cook-off/fuel fire protection device, that does not require traditional booster safe/arm ejection devices.

Another object of the invention is to allow pressure buildup inside the warhead, which includes the booster and main charge explosives, to pass through a loading port cover thereby exposing the main charge explosive and the booster to flame and free to burn in a nondestructive manner.

These and further more advantageous benefits and features of the invention will become more readily apparent to the reader on consideration of the attached drawing, together with the following description of a preferred embodiment in the light of the appended claims.

DESCRIPTION OF THE PREFERRED EMBODIMENT

Figure 1:
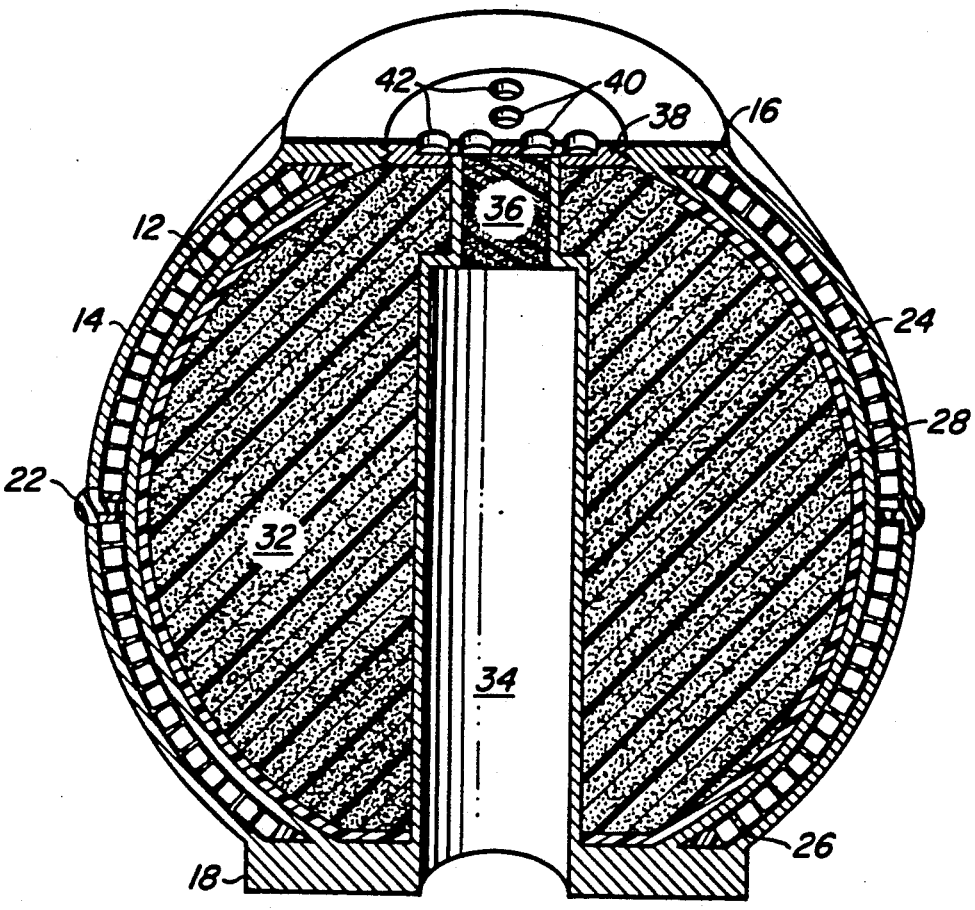
FIG. 1 illustrates a cross section of the spherical warhead through the center of said sphere.
Figure 2:
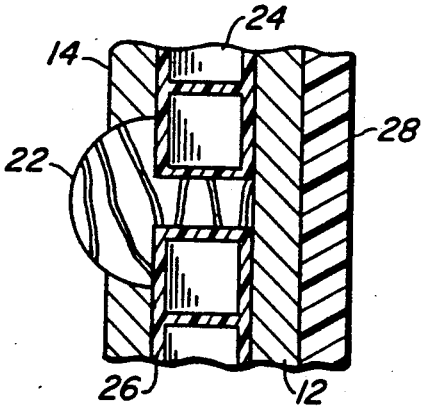
FIG. 2 is an enlarged sectional view of the medial metal ring shown in FIG. 1.

The invention warhead, illustrated in cross section (cut in half) in the Figure, is basically a spherical design. It consists of an inner 12 and an outer 14 metal spheres attached to a first 16 and a second 18 metal bulkhead/-cover plates. Half way down the warhead, between inner 12 and outer 14 spheres, is a permeable/porous metal ring 22, see FIG. 2. Preformed tungsten cubes 24 are poured first from one end while the assembly is vibrated and, when full, poured from the other end until the opposite side of the warhead is full of cubes. Center ring 22 serves two purposes, first as a spacer during assembly to keep proper space between inner 12 and outer 14 spheres, and second as a stacking surface so that stacking of cubes 24 can be started at the center and largest diameter of the warhead. When all cubes have been placed into the warhead, cubes 24 are then potted in place with a potting compound 26 by setting the warhead on end and drawing a vacuum from the top side, allowing the vacuum to pull the potting material up through the cubes and out the top. When the potting material has set up, the warhead is then lined with an inert material 28 (e.g. polyethylene) compatible with the main charge explosive 32. The warhead is then loaded with an explosive 32, e.g. PBX 116 (M) an RDX military explosive. Outer metal sphere 14 serves to hold cubes 24 and potting material 26 in place during fabrication, provides a limited amount of structural strength, and serves as protection for the completed warhead for minor scratches and abrasions. Inner liner 28 provides separation between inner sphere 12 and main charge explosive 32. The inner sphere 12 carries the main structural loads, and serves as a gas check to improve the fragment 24 accelerational capability of the explosive. Without inner sphere 12, fragment velocity losses of up to 40% will occur.

The warhead further contains a tube 34 running from the forward bulkhead, first plate 16, aft to the rear bulkhead, second plate 18. This tube provides the cavity for a safe/arm (S/A) fuze device to be inserted at a later time and is separate from the warhead. At one end of S/A tube 34 is a booster well 36, which will contain a booster explosive (e.g. CH-6). The booster explosive will be inserted, first into a thin plastic sleeve, and then into booster well 36 through a loading port 38 threaded into first plate (foreplate) 16. Through the design of the loading port cover and booster explosive location, a high degree of cook-off or fuel fire resistance is obtained. Pressure buildup due to the increase in temperature of the explosives, booster charge 36 or main charge 32, pass through vent holes 40 in loading port cover 38 allowing the explosive to burn rather than build up pressure to a detonation. Mounting holes 42 permit use of a spanner wrench to screw on loading port cover 38.

The warhead is currently designed to achieve at least 120° of polar angle radial dispersion. This angle is measured from the nose to the tail of the missile system. Static tests with this warhead indicated that the current design produces fragmentation starting between 25° to 30° off the nose and has fragmentation back to 150° to 155° from the nose of the missile. In the actual design and fabrication of the warhead a number of alternatives exist. First, all metal parts except for the fragments are aluminum. However, any other easily formed metal alloy may also be used for this application. The preformed metal cubes in this warhead are of tungsten. Again, most other metal alloys could be used in this application. Also, the use of cubical shaped fragments is not a requirement. Spheres, although less efficient in use of the volume, are possible candidate fragment shapes as well. An electrical potting compund is used in this warhead to pot the cubes in place. However, any low viscosity material capable of being poured into place and cured into a rigid matrix is acceptable. A polyethylene liner was selected because of known compatibility with the PBXC-116 (M) main charge explosive. The main charge explosive need not be PBXC-116 (M). The liner need not be polyethylene. The only requirement is that the materials be chemically compatible. The plastic sleeve around the CH-6 booster explosive is polycarbonate. Again, compatibility is the main issue and none of the above materials are unique.

Although there has been described herein above a particular design and arrangement of components thereof for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A shaped charge missile warhead, comprising:

an outer and an inner concentrically spherical shells, each having a truncated aft and a truncated fore ends;

a first and a second cover plates, having means for attachment to said missile, said first plate being attached to and sealing off said truncated fore end, and said second plate being attached to and sealing off said truncated aft end;

a loading port disc insertable within said first cover plate, said disc having at least one hole/vent therethrough for passage of gas to release internal warhead pressure buildup;

a porous ring circumferentially mounted between said outer and inner spherical shells;

a plurality of fragmentation particles evenly dispersed and fixedly potted between said outer and inner spherical shells on either side of said porous ring;

a non-reactive liner means covering the interior of said inner shell for containing a high explosives; and cylindrical core means extending between said first and second cover plates for supporting a safe/arm fuze device and a booster charge.

* * * * *